United States Patent [19]

Uherek et al.

[11] Patent Number: 4,494,628

[45] Date of Patent: Jan. 22, 1985

[54] ELEVATOR SYSTEM

[75] Inventors: Vladimir Uherek, Troy Hills Township, Morris County; Matthew F. Kersen, Union, both of N.J.

[73] Assignee: Westinghouse Electric Corp., Pittsburgh, Pa.

[21] Appl. No.: 523,993

[22] Filed: Aug. 17, 1983

[51] Int. Cl.[3] ..... B66B 5/02

[52] U.S. Cl. ..... 187/29 R

[58] Field of Search ..... 187/29

[56] References Cited

U.S. PATENT DOCUMENTS

| | | | |
|---|---|---|---|
| 3,587,785 | 6/1971 | Krauer et al. | 187/29 R |
| 4,256,203 | 3/1981 | Masel | 187/29 R |
| 4,308,936 | 1/1982 | Caputo et al. | 187/29 R |
| 4,337,847 | 7/1982 | Schröder et al. | 187/29 R |
| 4,354,576 | 10/1982 | Kajiyama | 187/29 R |
| 4,367,811 | 1/1983 | Yoneda et al. | 187/29 R |
| 4,387,436 | 6/1983 | Katayama et al. | 187/29 R |
| 4,446,946 | 5/1984 | Kajiyama et al. | 187/29 R |

*Primary Examiner*—Bo B. Dobeck

*xaminer*—W. E. Duncanson, Jr.

*Attorney, Agent, or Firm*—D. R. Lackey

[57] ABSTRACT

An elevator system in which distance pulses are generated in response to travel of an elevator car, and used to update a car position counter. The difference between the car position count and a count representative of the location of the target floor is determined when the elevator car reaches a predetermined distance from the target floor, and this distance-to-go (DTG) count is used to provide a speed pattern for decelerating and landing the car at floor level. A zone of fixed length is provided on each side of each floor, and, when this zone is detected, the DTG count is compared with a count representative of this fixed length. If they differ within a predetermined tolerance, it is known that a proper landing will or can be made, and the DTG count is changed to the correct value at the instant the zone is detected. Door preopening may be enabled at this time. If the difference exceeds the predetermined tolerance, no corrective action is taken, and door preopening is not enabled. The amount of the difference may also be subjected to various checks for determining if the elevator car should be taken out of service, or allowed to continue to run.

8 Claims, 10 Drawing Figures

ELEVATOR SYSTEM

BACKGROUND OF THE INVENTION

1. Field of the Invention:

The invention relates in general to elevator systems, and more specifically to elevator systems which produce distance pulses responsive to car movement, and which maintain car position in terms of a count which is incremented and decremented by the distance pulses.

2. Description of the Prior Art:

U.S. Pat. No. 3,750,850, which is assigned to the same assignee as the present application, discloses an elevator system in which an electrical distance pulse or signal is generated in response to each predetermined increment of car travel, such as a distance pulse for each 0.25 inch of car travel. A car position counter is zeroed at the lowest point of car travel, and it is incremented and decremented by the distance pulses, according to travel direction. The car location, in terms of the distance count, when the car is level with each floor of the associated building, is assigned to the associated floor as its address. The car position count, suitably advanced by the normal slowdown distance, is compared with the floor addresses to determine when the car should initiate the slowdown phase of a run to stop at a target floor. The speed pattern generator also uses the car position count to generate the slowdown speed pattern by using the difference between the car position count and the address of the target floor to determine the distance-to-go (DTG) count. The DTG count is the distance from the elevator car to the target floor in terms of the standard increment.

To eliminate the possibility of inaccurate landings due to errors in the car position count, the floor addresses, or in the digital-to-analog conversion in the speed pattern generator, the slowdown pattern is switched to a landing pattern at a predetermined distance from the target floor. The landing pattern is not distance pulse derived, but is an analog signal developed in response to actual car location relative to the target floor by a hatch transducer. Signal blending, such as disclosed in U.S. Pat. No. 3,651,892, which is assigned to the same assignee as the present application, may be used to accommodate mismatches between the slowdown and landing patterns. Calibration of the square root device on each run may also be used to reduce mismatch at the low speed pattern transfer point between the slowdown and landing patterns, as disclosed in U.S. Pat. No. 3,747,710, which is also assigned to the same assignee as the present application.

While the prior art arrangements produce smooth, accurate landings, it would be desirable to be able to eliminate the costly hatch transducer, and to use a distance pulse derived speed pattern all the way to floor level. The problem with such an arrangement is that it is possible for several counts to be lost during a run. For example, the count circuitry may lose or gain counts because of noise during counting, and also noise during transmission of the information to the car controller. If the pulse wheel count is wrong by several counts, the DTG count will differ by the same number of counts, and thus the generated speed pattern will be incorrect. The car may still be able to land at the correct target floor, but it may overshoot or undershoot the landing. If the car overshoots the floor level, it will be forced to relevel, delaying landing. If it undershoots, the elevator car will take too much time to land and become level.

For example, at 2 FPM final speed, each two counts lost will delay landing by 1.25 seconds.

SUMMARY OF THE INVENTION

Briefly, the present invention is a new and improved elevator system which decelerates and lands an elevator car with a distance pulse derived speed pattern. A fixed zone is established on each side of each floor of the associated building, such as by a cam, retroreflective tape, or the like, with the cam or tape being detected by mechanical or optoelectronic apparatus, respectively, carried by the elevator car. The zones and car carried apparatus may be the same as that used to level and relevel the elevator car, of different zones and apparatus may be used. For example, the leveling zone, which is about ± two inches, may be used, eliminating the cost of separate zone establishing and detecting apparatus. At some contract speeds, longer zones may be necessary, and additional cams or tape strips, and an additional detector may be required. For example, the cam or tape which starts the landing timer may be used to define a longer zone, or entirely separate, dedicated zone establishing apparatus may be used.

The elevator car is decelerated towards the target floor on the distance pulse derived speed pattern. When the zone established adjacent to the target floor is detected, the length of the zone, which is fixed, is compared with the DTG count derived from the pulse wheel count (PWC). If the values are equal, no corrective action is required. If door preopening is used, it may be enabled at this point in time. If they differ within a predetermined tolerance, which tolerance is based upon the zone length, contract speed, and maximum desired jerk, it indicates that a landing without releveling may be salvaged by corrective action. The corrective action includes setting the DTG count to the correct value, which will then readjust the speed pattern to land the elevator car precisely at floor level. Door preopening, if used, may also be enabled.

If the DTG count and zone lengths differ by an amount which exceeds the predetermined tolerance, no corrective action is taken, as to do so would cause an objectionable "bump" to be felt in the elevator car as the speed pattern would abruptly change, and the car would try to follow the sudden pattern change. When the DTG count and the zone length differs by more than the predetermined tolerance, the car is simply allowed to overshoot or undershoot the landing, and to level, or re-level as required. Door preopening is disabled. Information may be stored in suitable memory means relative to each "poor" landing, such as storing the floor number and time of day in a poor landing record, which may be used by maintenance personnel. If the error exceeds a magnitude which indicates more than an electrical noise problem, such as a malfunction of the pulse wheel circuitry, the elevator car may be automatically taken out of service at the landing, with the reason for such action being stored in the memory means for the benefit of maintenance personnel. A software counter may also be used to count the number of poor landings experienced within a predetermined length of time, and as the count reaches a predetermined magnitude within the predetermined time limit, the elevator car may also be taken out of service.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

The invention relates to a new and improved elevator system, and more specifically to an elevator system in which distance pulses are used to generate both the slowdown and stopping speed patterns. Only those portions of an elevator system which are pertinent to the understanding of the invention will be described, with the remaining portions of a complete elevator system being incorporated by reference to issued patents and co-pending patent applications assigned to the same assignee as the present application. The patents incorporated by reference are U.S. Pat. Nos. 3,750,850; 4,277,825; 3,902,572; and 4,019,606. U.S. Pat. No. 3,750,850 sets forth a car controller, including a floor selector and speed pattern generator which utilizes distance pulses in their operation. U.S. Pat. No. 4,277,825 discloses elevator drive machine control which utilizes a speed pattern to control the speed of the elevator car. U.S. Pat. Nos. 3,902,572 and 4,019,606 illustrate cam/switch, and optoelectronic arrangements, respectively, which may be used to detect when the elevator car has reached predetermined zones relative to the target floor.

The co-pending applications incorporated by reference are Ser. No. 446,149, filed Dec. 2, 1982, entitled "Speed Pattern Generator For An Elevator Car", now U.S. Pat. No. 4,470,482 and Ser. No. 409,687, filed August 19, 1982, entitled "Elevator System" now U.S. Pat. No. 4,463,833. Application Ser. No. 446,149 describes a speed pattern generator which has been modified according to the teachings of the present invention, which speed pattern generator may be substituted for those shown in the incorporated patents. Application Ser. No. 409,687 sets forth elevator leveling control which may be used to provide certain input signals required by the speed pattern generator of the incorporated application.

Figure 1:
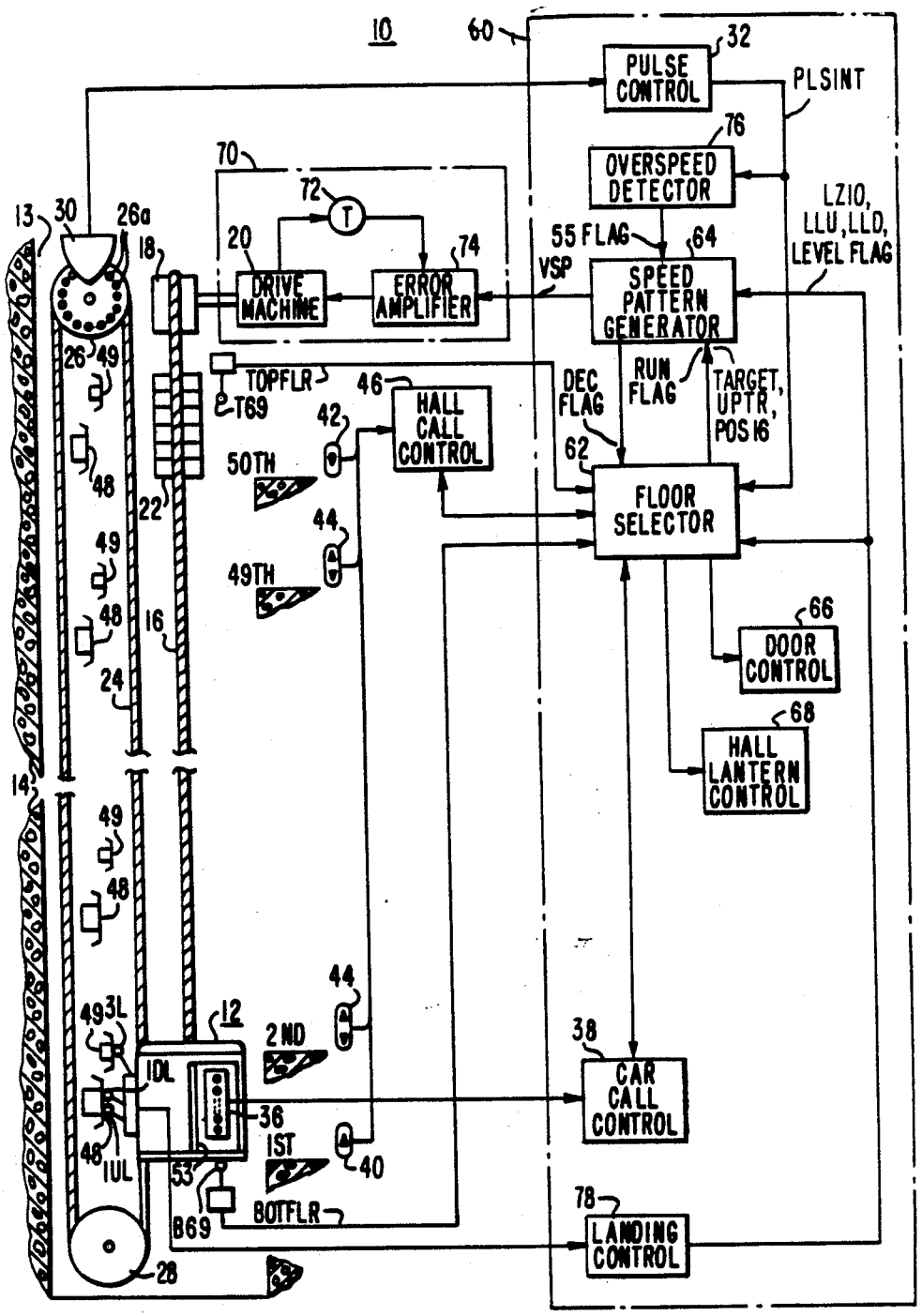
FIG. 1 is a schematic diagram of an elevator system which may utilize the teachings of the invention.

More specifically, FIG. 1 illustrates an elevator system 10 which may utilize the teachings of the invention. FIG. 1 is substantially the same as FIG. 1 of incorporated application Ser. No. 409,687. Elevator system 10 includes an elevator car 12, the movement of which is controlled by a car controller 60. Elevator car 12 includes a door 53, which will be referred to when a door preopening feature is described. Car controller 60 may be controlled by a system processor (not shown), when elevator system 10 is under group supervisory control. The car controller 60 includes a floor selector 62 and a speed pattern generator 64. The floor selector 62 is described in detail in incorporated U.S. Pat. No. 3,750,850. It is sufficient for the understanding of the present invention to state that the floor selector 62, in addition to providing signals for door control 66 and hall lantern control 68, provides signals RUN, TARGET and UPTR for the speed pattern generator. The signal RUN is true when the floor selector 62 detects a need for elevator car 12 to make a run. TARGET is the floor height, or address, in binary, of the next stop for the elevator car. The speed pattern generator 64 compares the AVP floor (the next floor in the direction of the elevator car at which the car can make a normal stop) with the address TARGET of the target floor, to determine when the slowdown phase of a run should start. Signal UPTR is the travel direction signal prepared by the floor selector 62, with UPTR being a logic one for the up-travel direction, and a logic zero for the down-travel direction.

Car 12 is mounted in a hatchway 13 for movement relative to a structure 14 having a plurality of landings, such as 50, with only the 1st, 2nd, 49th and 50th floors or landings being shown, in order to simplify the drawing. The car 12 is supported by a plurality of wire ropes 16 which are reeved over a traction sheave 18 mounted on the shaft of a drive machine 20. The drive machine 20 may be an AC system having an AC drive motor, or a DC system having a DC drive motor, such as used in the Ward-Leonard drive system, or in a solid state drive system. The drive machine 20, along with its associated closed loop feedback control is referred to generally as drive machine control or motor control 70. Motor control 70, which is shown in detail in incorporated U.S. Pat. No. 4,277,825, includes a tachometer 72 and an error amplifier 74. The tachometer 72 provides a signal responsive to the actual rotational speed of the drive motor of the drive machine 20, and error amplifier 74 compares the actual speed signal with the desired speed signal represented by the speed pattern signal VSP provided by the speed pattern generator 64.

A counterweight 22 is connected to the other ends of the ropes 16. A governor rope 24, which is connected to the car 12, is reeved over a governor sheave 26 located above the highest point of travel of the car 12 and the hatchway 13, and under a pulley 28 located at the bottom of the hatchway. Pick-up 30 is disposed to detect movement of the elevator car 12 through the effect of circumferentially-spaced openings 26*a* in the governor sheave 26, or in a separate pulse wheel which is rotated in response to the rotation of the governor sheave. The openings 26a are spaced to provide distance pulse for each standard increment of travel of the elevator car 12, such as a pulse for each 0.25 inch of car travel. Pick-up 30 may be of any suitable type, such as optical or magnetic. Pick-up 30 is connected to pulse control 32 which provides distance pulses PLSINT for floor selector 62. Distance pulses may be developed in any other suitable manner, such as by a pick-up disposed on the elevator car 12 which cooperates with a coded tape disposed in the hatchway, or other regularly spaced indicia in the hatchway.

The distance pulses may also be used by an overspeed detector 76. The pulse rate is an indication of car speed. A simple overspeed detector may be provided by a switch/low pass filter arrangement, such as the arrangement shown in FIG. 18 of incorporated U.S. Pat. No. 3,750,850. This arrangement provides an analog output having a magnitude proportional to pulse rate. The output of the filter may be connected to an input of a comparator. Another input of the comparator is connected to a reference. If the output of the filter exceeds the reference, the output of the comparator will switch from one logic level to the other, providing a true signal which is referred to as the 55 flag. The 55 flag is another input signal used by the speed pattern generator 64.

Car calls, as registered by pushbutton array 36 mounted in the car 12, are processed by car call control 38, and the resulting information is directed to the floor selector 62.

Hall calls, as registered by pushbuttons mounted in the hallways, such as the up pushbutton 40 located at the 1st floor, the down pushbutton 42 located at the 50th floor, and the up and down pushbuttons 44 located at the 2nd and other intermediate floors, are processed in hall call control 46. The resulting processed hall call information is directed to the floor selector 62.

The floor selector 62 tabulates the distance pulses from the pulse detector 32 in an up/down counter to develop information concerning the precise position of the car 12 in the hatchway 13, to the resolution of the standard increment. When the car 12 is at its lowest landing in the hoistway, the car position count, referred to as POS16, is set to a predetermined value. The POS16 count when the car 12 is level with each floor is used as the address for the associated floor. These addresses or floor heights are stored in look-up table in ROM, which is indexed by the car's AVP. The speed pattern generator 64 also uses the POS16 count.

The floor selector 62, in addition to keeping track of the position of the car 12, also tabulates the calls for service for the car, and it provides signals for starting the elevator car on a run to serve calls for elevator service.

The floor selector 62, and also the speed pattern generator 64, if desired, develop an advanced floor position for the elevator car 12, referred to as the AVP floor, or simply as AVP. The advanced floor position AVP is the closest floor ahead of the elevator car 12 in its travel direction at which the car can stop according to a predetermined deceleration schedule. The floor at which the car 12 should stop, to serve a car call or a hall call, or simply to park, is referred to as the target floor. When the AVP of the car 12 reaches the address TARGET of the target floor, the speed pattern generator initiates the slowdown phase of the run. Floor selector 62 also controls the resetting of the car calls and hall calls when they have been serviced.

Figure 1A:
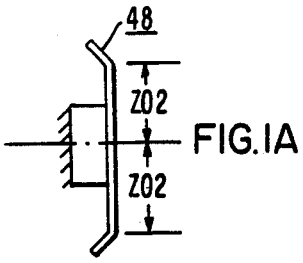
FIG. 1A is an enlarged view of the floor zone landing cam shown in FIG. 1.
Figure 1B:
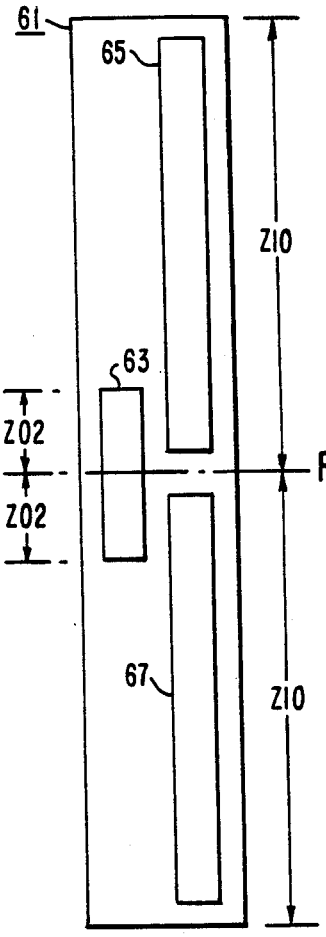
FIG. 1B illustrates how floor zones may be established by retroreflective tape, which tape may be used instead of the cams shown in FIGS. 1 and 1A.

Accurate landing and leveling of the car 12 at each floor may be accomplished by leveling switches 1DL and 1UL mounted on the elevator car 12, which cooperate with leveling cams 48 at each floor, as described in incorporated U.S. Pat. No. 3,902,572. Cams 48 each define a leveling zone of ± 2 inches, for example. A switch 3L mounted on the car 12 and cams 49 mounted in the hoistway may also be used to determine when the elevator car is a predetermined different distance from a floor than the leveling zone, such as ten inches. Alternatively, the optoelectronic arrangement 61 of U.S. Pat. No. 4,019,606, the reflectors 63, 65 and 67 of which are shown in FIG. 1B, may be used to provide these absolute car position signals.

As shown in incorporated application Ser. No. 409,687, switches 1UL, 1DL and 3L may be connected to control the operative state or condition of electromagnetic relays LU, LD and L2, respectively, shown generally as landing control 78.

When car 12 is within about ± 0.25 inch of floor level, both switches 1UL and 1DL will be on a cam 48, and their associated relays LU and LD will both be energized (or both deenergized). If the car 12 moves up or down from the level position, switch 1UL or switch 1DL will come off the cam and dropout (or pick up) relay LU or LD, respectively, to initiate up or down releveling. A zone of ±2 to 3 inches is provided about each floor level, in which at least one of the switches 1DL or 1UL is on a cam, which zone thus defines the releveling zone. This zone on each side of floor level will be referred to as the Z02 zone.

As described in the hereinbefore mentioned incorporated application, Ser. No. 409,687, switch 3L may control a relay L2 which starts a timer LT2 a predetermined distance, such as ten inches from the target floor. This zone on each side of floor level will be called the Z10 zone. The LT2 timer is set to a value which represents the normal time for the elevator car to move from the predetermined point, such as the ten inch point, to the leveling zone. When the LT2 timer times out, this fact may be used to initiate a leveling program, if the elevator car 12 is not within ± 0.25 inch of floor level.

When car 12 needs releveling, the LT2 timer and switches 1UL and 1DL may also set a flip-flop, or other suitable memory, which, when set, provides a true flag LEVEL, which may be used by the speed pattern generator 64 to initiate a leveling speed pattern.

Figure 2:
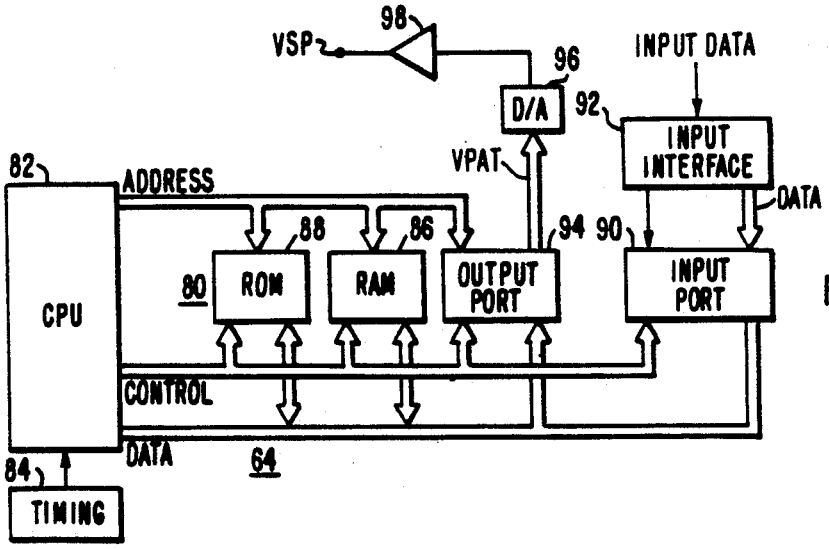
FIG. 2 is a schematic diagram of a microcomputer which may be used to implement the teachings of the invention.

The present invention is preferably implemented by a digital computer, and more specifically by a microcomputer. FIG. 2 is a schematic diagram of a microcomputer arrangement 80 which may be used. All of the functions of the car controller 60 may be implemented by the single microcomputer 80, which simplifies the communication between the floor selector and speed pattern generator functions, as they may use a common random access memory (RAM). However, since the present invention relates primarily to the speed pattern function, it simplifies the description to merely state what signals the speed pattern generator receives from other functions, and to refer to patents or patent applications for apparatus which can provide such signals.

More specifically, microcomputer 80 includes a central processing unit (CPU) 82, system timing 84, a random access memory (RAM) 86, a read-only memory (ROM) 88, an input port 90 for receiving signals from external functions via a suitable interface 92, an output port 94 to which the digital speed pattern signal VPAT is sent, a digital-to-analog (D/A) converter 96, such as Analog Devices 565, and an amplifier 98 which provides the analog speed pattern signal VSP. The microcomputer 80, for example, may be INTEL's iSBC80/24 TM single board computer. With this computer, the CPU would be INTEL's 8085A microprocessor, the timing function 84 would include INTEL's clock 8224, and the input and output ports would be onboard ports.

The actual car position POS16 may be maintained by a solid state, binary up/down counter, and/or the floor selector function may be provided by the microprocessor 80 shown in FIG. 2 If the latter, the microprocessor 80 may maintain a counter in RAM 86 for maintaining the car position, which count will be referred to as POS16.

The speed pattern generator 64 may include a plurality of function modules, each of which controls a specific portion of the speed pattern VSP. The function modules are under the control of a supervisory or logic module referred to as module PGLOGC. Module PGLOGC is periodically run throughout the entire run of the elevator car 12, as well as when the elevator car 12 is standing at a floor. When the floor selector 62 determines that a run should be made and sets the flag RUN, module PGLOGC calls a function module PGINIT. This module initiates the speed pattern and enables a module PGTRMP. Module PGTRMP provides a time ramp function, and its output provides a time dependent portion of the speed pattern VSP. Module PGINIT sets a flag ACCEL. When module PGLOGC runs again, it will call a module PGACC, because of the flag ACCEL being set. Module PGINIT sets the desired maximum acceleration rate for the time ramp generator module. At the proper time module PGACC sets the desired acceleration to zero. This occurs when the car's AVP reaches the target floor, or when the pattern magnitude $V_D$ reaches rated speed $V_{FS}$ minus a predetermined constant K. Module PGACC then calculates the car slowdown distance SLDN, and it sets a flag MIDRN. Module PGLOGC then calls a module PGMID the next time it runs, in response to flag MIDRN being set. Module PGMID uses the distance SLDN to determine when the car 12 is located the distance SLDN from the AVP floor. When it detects that the car has reached the distance SLDN from the AVP floor, and the AVP floor is the target floor, it sets the desired acceleration for the module PGTRMP, and it sets a flag DECEL. The next time module PGLOGC runs, it will call a module PGDEC as a result of flag DECEL being set. Module PGDEC calculates a digital pattern $V_{SD}$ and it detects when the time based portion of the pattern crosses the distance based portion $V_{SD}$. At the crossing point, module PGDEC disables the module PGTRMP, and it substitutes the distance based pattern for the time based pattern. At the landing distance DLAND from the target floor, module PGDEC may continue to provide the landing speed pattern, or it may transfer control to an auxiliary pattern generator, which in the present invention may also derive its pattern from distance pulses. If releveling is required, module PGLOGC calls a module PGRLVL, which provides the releveling speed pattern.

Figure 3:
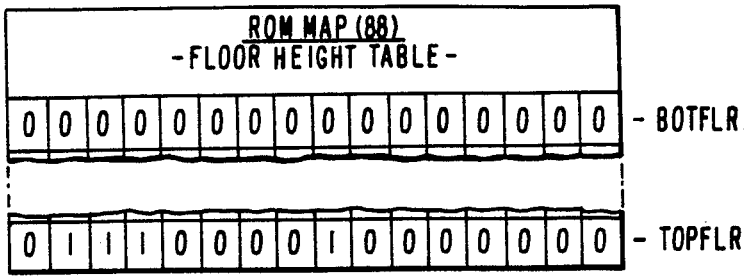
FIG. 3 is a ROM map which sets forth a floor height table used by the elevator system of claim 1.

Each floor of a building is assigned a binary value corresponding to its height or distance from the lowest car travel point in the building, with the binary value being in the terms of the standard increment. The binary value for each floor is maintained in a floor height table, indexed by the car's AVP stored in ROM 88, with FIG. 3 being a ROM map which sets forth a suitable format for the floor address table. Also, ROM 88 may include a look-up table indexed by the DTG count for obtaining a landing pattern. ROM 88 will also include all of the constants used by the function modules.

Figure 4:
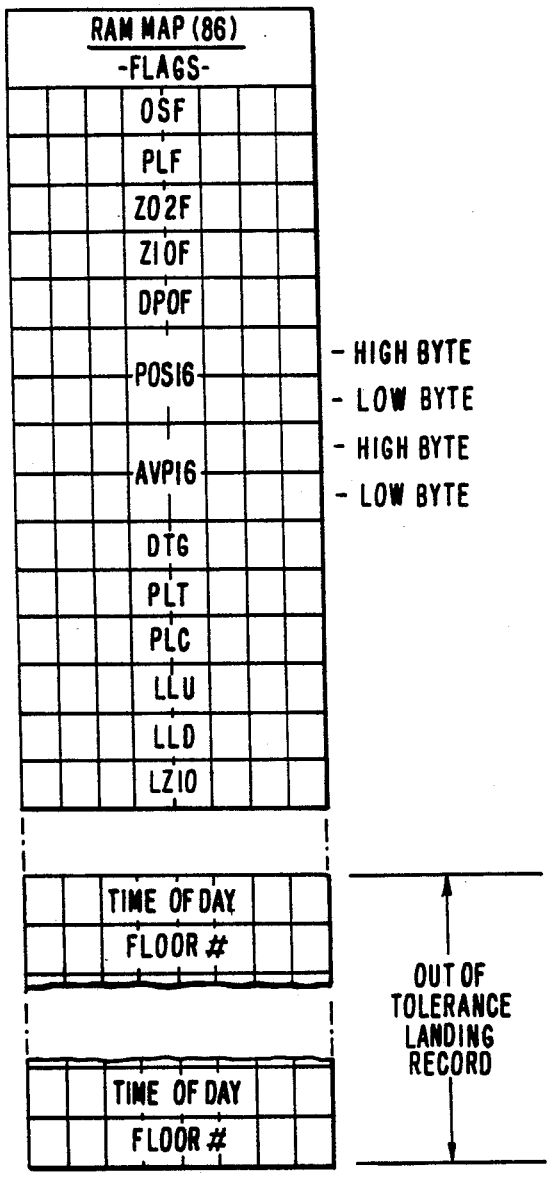
FIG. 4 is a RAM map which sets forth certain flags and program variables stored in RAM, in preferred embodiments of the invention.

FIG. 4 is a RAM map which sets forth suitable formats for certain data which may be stored in RAM 86. This data includes the flags RUN, LEVEL and 55, which flags are set externally to the speed pattern generator, the flags which are set and reset by the pattern generator modules, and a plurality of other signals and program variables which will be referred to when the various modules are described in detail.

Figure 5:
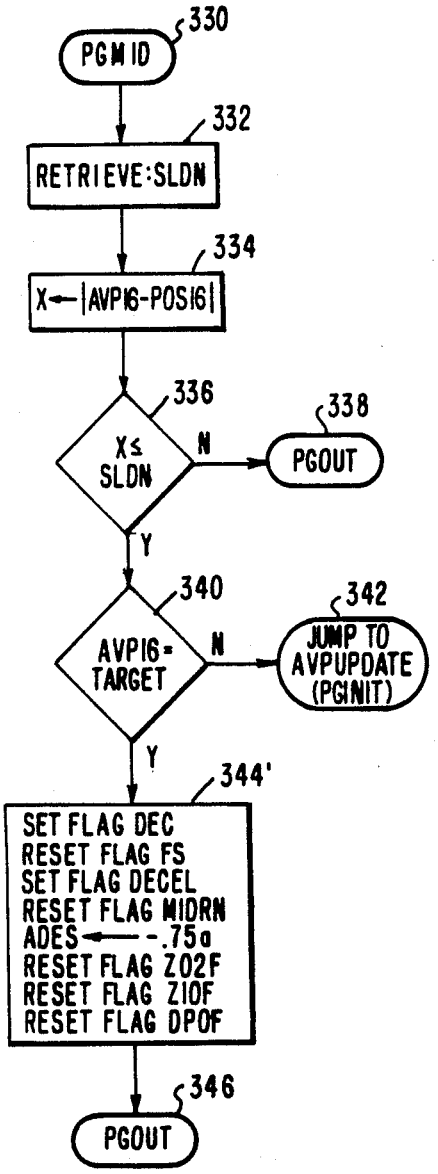
FIG. 5 is a flow chart of a function module PGMID which is called by a logic module PGLOGC to determine when the slowdown phase of a run should start.

FIG. 5, which is similar to FIG. 13 of incorporated Application Ser. No. 446,149, is a flow chart of a module PGMID which is placed in bid by a module PGACC when the AVP floor is found to be the target floor, or when the speed VPAT reaches contract speed.

Module PGMID is entered at point 330 and step 332 fetches the distance SLDN calculated in module PGACC. Step 334 determines the distance from the current car position POS16 to the address AVP16 of the AVP floor. Step 336 compares this distance with the distance SLDN. If the car has not reached the slowdown distance for the AVP floor, the program exits at 338 as there is nothing to do until the car reaches this point. When step 336 finds the car has reached the distance SLDN from the AVP floor, step 340 compares AVP16 with TARGET to see if the AVP floor is the target floor. If it is not the target floor, step 342 jumps to program module PGINIT to update the AVP floor. When step 340 finds the car has arrived at the distance SLDN from the target floor, step 344' sets flag DEC, used by the floor selector, it resets flag FS, also used by the floor selector, it resets flag MIDRN, it sets flag DECEL, and its sets the desired deceleration rate ADES. Thus, when module PGLOGC runs again, it will transfer control to module PGDEC. Deceleration is also initiated by this step by setting ADES to $-\frac{3}{4}$ths of the rated acceleration a. As illustrated, step 344' may also reset certain flags, such as Z02F, Z10F and DPOF, which flags will be hereinafter described.

In a first embodiment of the invention, it will be assumed that the distance based speed pattern provided by module PGDEC will be used to land the car at floor level, as well as to decelerate the car from the cross over point between the time and distance based speed patterns. It will further be assumed that the contract speed is such that the landing and releveling zone Z02 is of sufficient length to correct the speed pattern for normal errors in the car position count. FIG. 1A illustrates an enlarged view of cam 48 shown in FIG. 1, and FIG. 1B illustrates retroreflective tape 63 used to establish the Z02 zones.

Figure 6A:
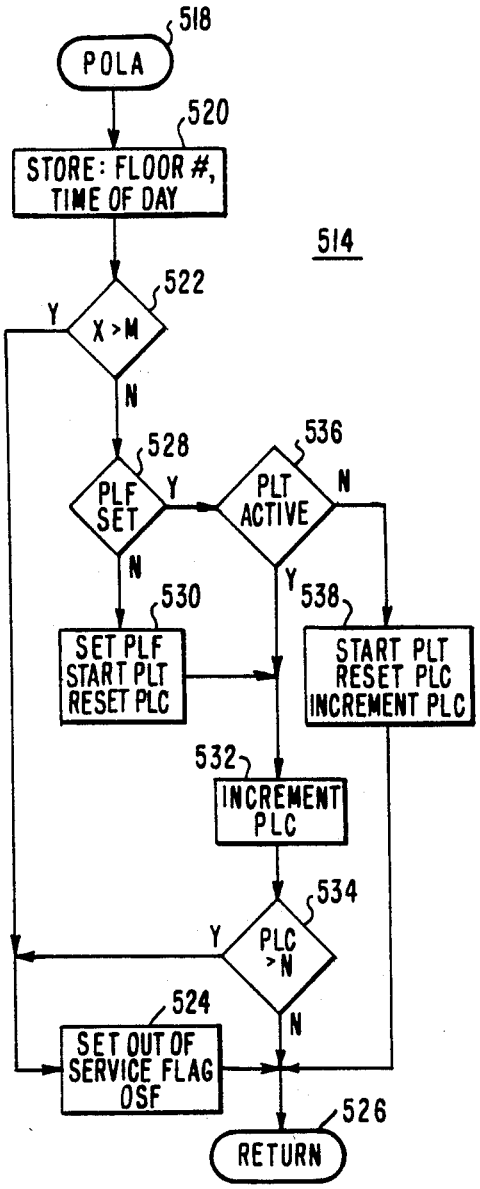
FIG. 6A is a flow chart of a subroutine POLA which may be called by the modules shown in FIGS. 6, and 7.
Figure 6:
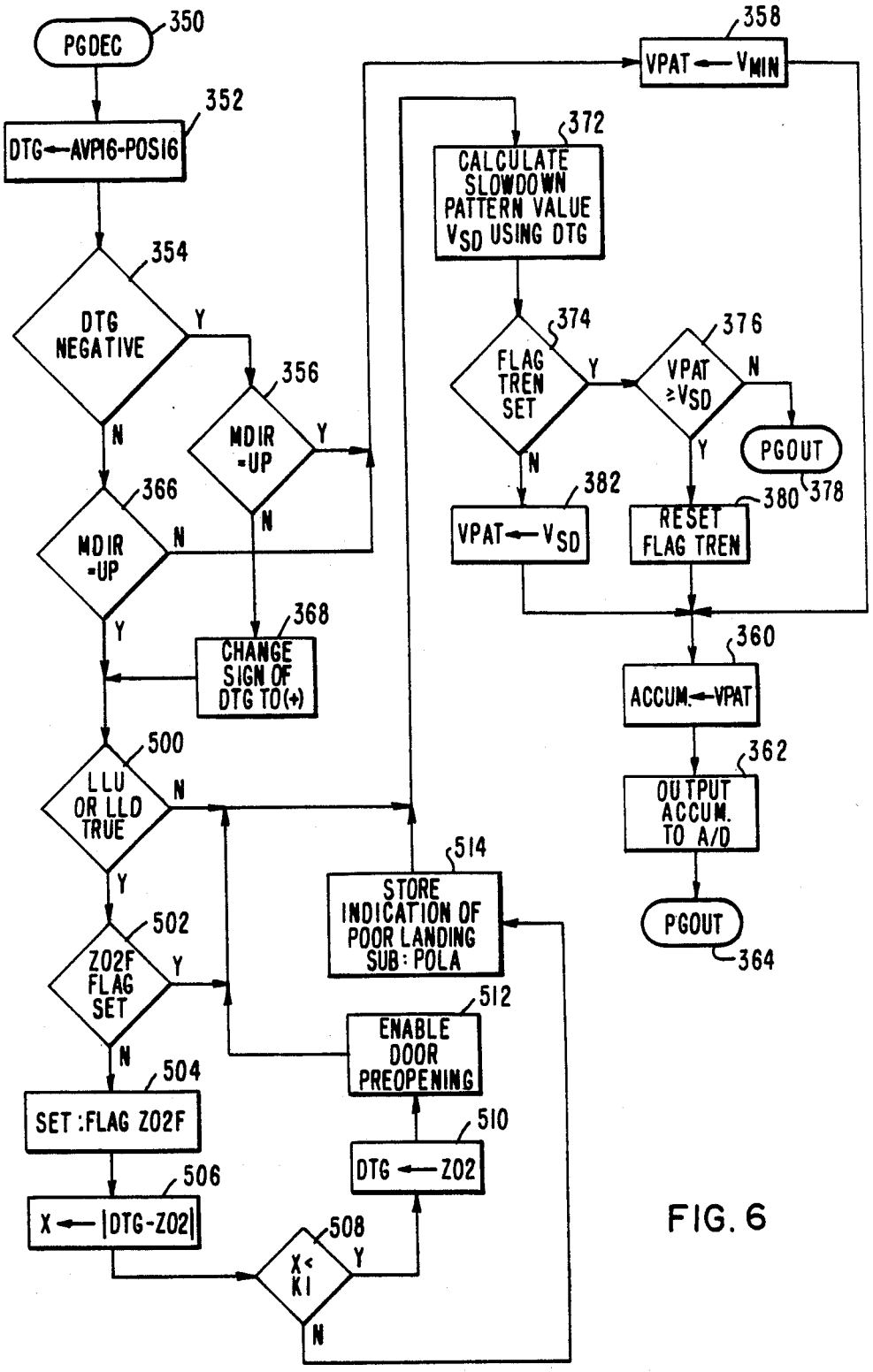
FIG. 6 is a flow chart of a function module PGDEC constructed according to an embodiment of the invention when module PGMID finds the distance SLDN is equal to the distance between the elevator car and target floor, with module PGDEC generating a distance based portion of the speed pattern using the distance-to-go (DTG) count.

Fig. 6 is a flow chart for module PGDEC which is similar to FIG. 14 of incorporated Application Ser. No. 446,149, except modified according to an embodiment of the invention.

PGDEC is entered at point 350 of FIG. 6 and step 352 determines the distance-to-go (DTG) count by subtracting the count value POS16 representative of the current position of the elevator car from the count value AVP16 of the AVP floor. Step 354 checks to see if DTG is negative, and step 356 checks the car travel direction. If DTG is negative and the travel direction is up, the car has passed the AVP floor and step 358 sets the speed pattern value VPAT equal to a predetermined value $V_{MIN}$, which is the minimum landing speed. Step 360 outputs the new value for VPAT to the accumulator, step 362 sends the value in the accumulator to the D/A converter 96, and the program exists at 364. Releveling will be initiated by the car controller, such as by the arrangement set forth in the incorporated application Ser. No. 409,687. In like manner, if step 354 finds DTG positive, step 366 checks the car travel direction MDIR. If it is down, the car has passed the AVP floor and step 366 proceeds to step 358.

If steps 366 or 356 find the car has not passed the AVP floor, they proceed to step 500 which checks to see if the elevator car 12 has reached the zone Z02. Step 500 may do this by checking RAM 86 to see if either of the logic signals LLU or LLD are true, indicating a switch 1UL or 1DL has contacted cam 48. If zone Z02 has not been reached, step 500 proceeds to step 372. Step 372 determines the digital value $V_{SD}$ of the desired speed pattern at this point, using the value of the distance-to-go count DTG.

Step 374 then checks to see if the time ramp generator is still enabled. If it is, it means that the pattern generator is still in the time based phase, and step 376 checks to see if the high speed pattern transfer point has been reached, by determining if VPAT equals or exceeds the value of $V_{SD}$. If the high speed pattern transfer point has not been reached, there is nothing more to do this time, and the program exits at 378.

When step 376 finds VPAT is equal to or greater than $V_{SD}$, step 380 disables the time ramp generator module PGTRMP by resetting flag TREN, and step 380 proceeds to step 360. The next time module PGDEC runs, step 374 will find flag TREN reset, and it will proceed to step 382 which places the value of $V_{SD}$ in memory location VPAT, to now make the speed pattern responsive to the distance-to-go value $V_{SD}$.

When step 500 finds LLU or LLD true, step 502 checks flag Z02F in RAM 86 to see if this is the initial detection of zone Z02. If flag Z02F is set, the Z02 zone was detected in earlier pass, and step 502 proceeds to step 372, which will be calculating the slowdown pattern based on a DTG count which is known to be accurate.

On the initial detection of zone Z02, step 502 proceeds to step 504 which sets flag Z02F so step 502 will subsequently skip the steps starting with step 504 and proceed directly to step 372.

Step 504 proceeds to step 506, with step 506 comparing the DTG count at the instant zone Z02 is detected, with the known and fixed length of zone Z02. This length is stored as a constant in ROM 88 in terms of the standard count. Step 506 determines the absolute value of the difference between the DTG count and the Z02 count, and it stores this difference in a location x in ROM 86. Step 508 then checks to see if x is less than a predetermined value or tolerance K1, which is also stored in ROM 88. The value of K1 is the maximum mismatch which will still allow the speed pattern to be corrected to cause the elevator car to land without undershooting, overshooting, and without exceeding a jerk magnitude which would be uncomfortable for the passengers.

If step 508 finds x to be within the predetermined tolerance, i.e., less than K1, step 510 stores the count value for Z02, which is stored as a constant in ROM 88, in the location of RAM 86 reserved for the DTG count. Thus, if the DTG count and the Z02 count are different, the DTG count will be changed to the correct value.

If door preopening of door 53 is a feature utilized by the elevator system, it is now known that the elevator car will land properly at the target floor without overshooting or undershooting, and step 512 may enable the door preopening feature, such as by setting a flag DPOF in RAM 86 which will be utilized by the floor selector 62 and door operator control 66. Step 512 then proceeds to step 372, which now calculates the speed pattern $V_{SD}$ using the precise DTG count which defines the distance from the elevator car to the floor level of the target floor.

Should step 508 find that the count difference between the DTG count and the Z02 count is not less than K1, step 508 bypasses steps 510 and 512. Thus, no attempt is made to correct the DTG count, and preopening of door 53 is not enabled. The elevator car is thus allowed to undershoot and creep to the floor, or overshoot and relevel, within the normal built in jerk constraints, while maintaining the car and hatch doors closed to prevent passenger exit until the elevator car is precisely at floor level.

The "no" branch of step 508 may proceed directly to step 372, or it may be used to call a subroutine for providing information for maintenance personnel. In certain instances it may even be used to take the car out of service, after its has leveled with the target floor. Also, instead of calling a subroutine at this time, it may simply set a flag which places the subroutine into bid. The subroutine called by step 514, or by an appropriate flag, is shown in detail in FIG. 6A.

Subroutine POLA, shown in FIG. 6A is entered at 518, and step 520 stores the floor number and the time of day in RAM 86 shown in FIG. 4, such as in the portion of RAM 86 referenced "out of tolerance landing record". Step 522 checks to see if x exceeds a predetermined value M stored in ROM 88. The value of M is selected such that if x exceeds this value, it is known that a malfunction has occurred in the pulse circuits, and the elevator car should not be allowed to make another run until the problem has been corrected. If x does exceed M, step 524 sets an out-of-service flag OSF in RAM 86, which will be checked by another module after the car has stopped at floor level and its doors have opened. If flag OSF is found to be set, the car will be taken out of service and not allowed to make another run until returned to service by authorized maintenance personnel. The fact that the elevator car has been taken out of service may be automatically communicated to on-site, or off-site service personnel via suitable communication means, if desired. Step 524 returns to the main program at 526.

If step 522 does not find that x exceeds the malfunction constant M, step 528 checks to see if a poor landing flag PLF has been set. If it is not set, it indicates that this is the first poor landing detected, at least for a predetermined time interval, and step 530 sets the poor landing flag PLF in RAM 86. Step 530 also starts a poor landing timer PLT, and it resets a poor landing counter PLC. Timer PLT may be a software timer in RAM 86, which is set to a predetermined value by step 530. Active timers may be decremented in a timer module, and when timer PLT is decremented to zero, the flag PLF may be reset. Counter PLC may be a software timer in RAM 86.

Step 530 then proceeds to step 532 which increments the poor landing counter PLC. Step 534 checks to see if the count registered on PLC exceeds a predetermined value N. The value of N is selected such that if this number of poor landings has occurred within the timer period of PLT, the elevator car should be taken out of service. On this loop through POLA, step 534 will not find that the count on counter PLC exceeds the predetermined number N, and step 534 returns to the main program at 526.

When another poor landing occurs within the predetermined time period, step 528 will proceed to step 536 to check if the poor landing timer PLT is active. If it is, step 536 proceeds to step 532, hereinbefore described. If step 534 finds the PLC count exceeds the predetermined value, step 534 proceeds to step 524 to set the out of service flag OSF. If step 536 finds the timer has timed out, step 536 proceeds to step 538 which starts timer PLT, it resets the counter PLC, and it then increments the PLC count. Step 538 returns to the main program at 526.

The program shown in FIG. 6 could use any zone indicated relative to floor level, such as the zone indicator defined by cam 49 and switch 3L, which combination starts a landing timer. The landing timer zone, for example, may start 10 inches from floor level, and, as hereinbefore stated, it is referred to as zone Z10. FIG. 1B illustrates how zone Z10 may be indicated by retro-reflective tape 65 and 67, instead of a cam 49.

Figure 7:
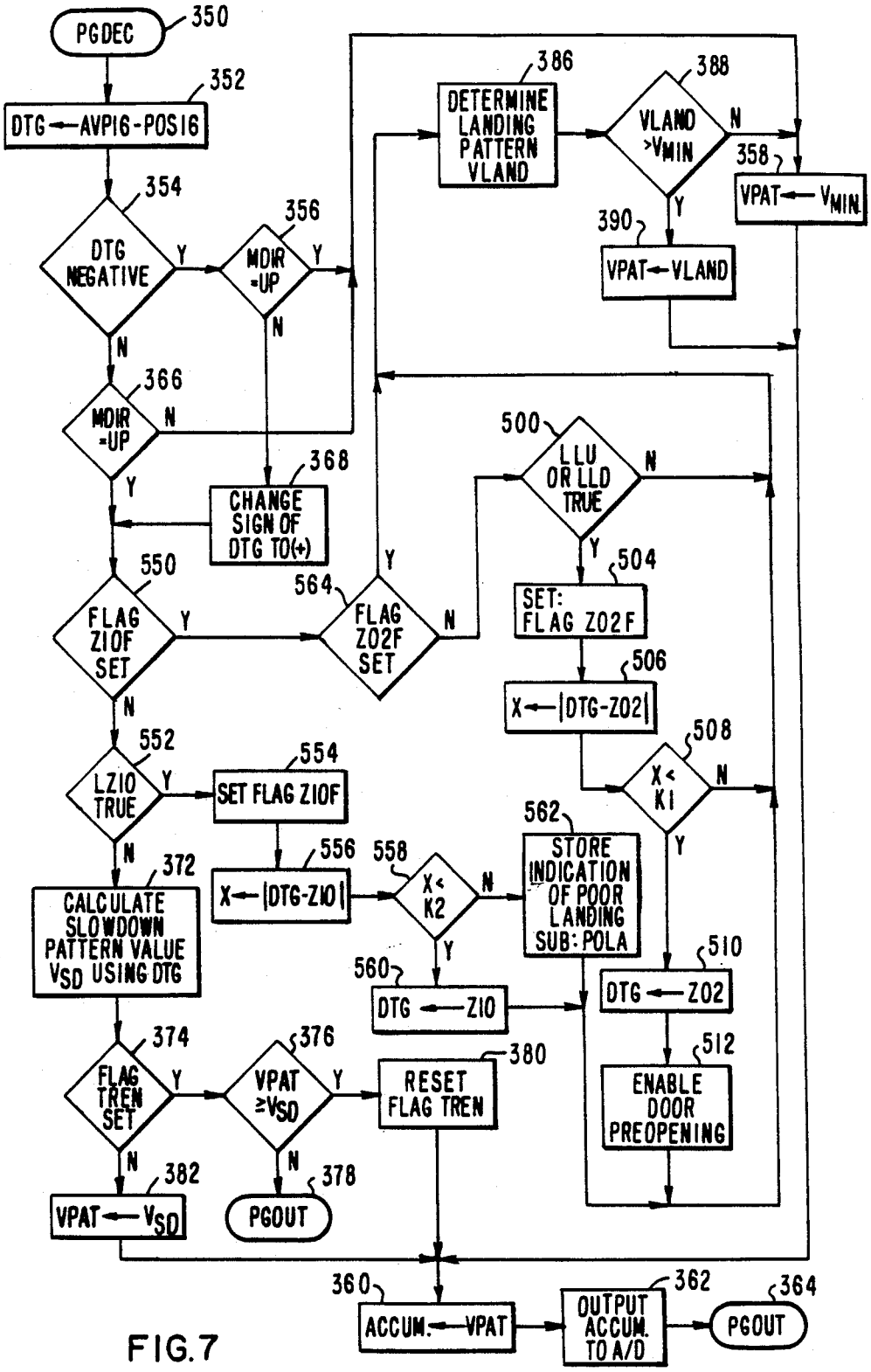
FIG. 7 is a flow chart of a function module PGDEC shown in FIG. 6, except modified according to another embodiment of the invention.

FIG. 7 illustrates how both the zones Z10 and Z02 may be used, with FIG. 7 being a modification of FIG. 13 of incorporated application Ser. No. 446,149. The steps of FIG. 7 which have already been described relative to FIG. 6, are identified with the same reference numerals and will not be described again.

More specifically, steps 366 and 368 both proceed to a step 550 which checks to see if a flag Z10F in RAM 86 is set. If not, zone Z10, which may have a length of 10 inches, as hereinbefore mentioned, has not been previously detected on this run, and step 550 proceeds to step 552 to check if the logic signal ZL10 is true. Signal ZL10 is stored in RAM 86, and it is changed to a logic 1 or true level when the Z10 zone is detected. If step 552 finds LZ10 not true, the Z10 zone has not yet been reached and step 552 proceeds to step 372, which calculates the speed pattern $V_{SD}$ using the DTG count.

If step 552 finds the elevator car has now reached the LZ10 zone, step 554 sets flag Z10F in RAM 86. Since the precise distance from the car to the level of the target floor is now known to equal the length of zone Z10, step 556 compares the DTG count with a count representative of the length of zone Z10, and it stores the absolute difference in a location of RAM 86 for storing a variable x. Step 558 checks to see if x is less than a predetermined value K2. K2, which is stored as a constant in ROM 88, is the maximum difference which will still allow the elevator car to land at the target floor, without undershooting, overshooting, and without exceeding a predetermined maximum jerk. If step 558 finds the difference count x within the allowable tolerance indicated by K2, step 560 sets the DTG count to the count value of the Z10 zone. Step 560 then proceeds to step 386 which determines a landing pattern VLAND. In this embodiment of the invention, instead of calculating the landing pattern from the 10 inch point, which would also be suitable, the pattern is determined from a look-up table in ROM 88, as described in incorporated Application Ser. No. 446,149. For example, at the 10 inch point, the first value in the look-up table for the landing pattern shown in ROM 88 may be read. Each distance pulse then indexes the look-up table to provide the next digital value of VLAND. Thus, the speed pattern VLAND may be said to be based upon the distance pulses, since the distance pulses initiate the indexing of the look-up table. Step 386 proceeds to step 388 to make sure that the value of VLAND exceeds the minimum landing speed $V_{MIN}$. If it does not, step 388 proceeds to step 358 which sets VPAT equal to $V_{MIN}$. If the value of VLAND exceeds the minimum value $V_{MIN}$, step 390 sets VPAT equal to VLAND.

If step 558 finds x is not less than the predetermined value K2, step 562 may call the subroutine POLA shown in FIG. 6A, and hereinbefore described.

When step 550 finds flag Z10F set, it is known that the elevator car is within the Z10 zone, and step 550 proceeds to step 564 to determine if the landing zone Z02 has been detected. If flag Z02F is not set, zone Z02 has not been previously detected, and step 500 checks to see if the car has reached the Z02 zone. Steps 504 through 512 are then followed, and they are the same as hereinbefore described relative to zone Z02 in the FIG. 6 embodiment, and thus they need not be described again in detail.

Since the poor landing record is maintained relative to the Z10 zone, it may be redundant to provide another poor landing record relative to the Z02 zone, and thus step 514 of FIG. 6 is not used in the embodiment of FIGS. 7A and 7B. Step 508 at FIGS. 7A and 7B may proceed to a step similar to step 514, however, if desired.

In summary, there has been disclosed a new and improved elevator system which permits a distance pulse based speed pattern to be used to land an elevator car, eliminating the need for switching the slow down pattern to a landing pattern provided by a hatch transducer. The present invention detects the start of a fixed zone relative to a target floor, and it compares the DTG count with a count representative of the zone distance. If they are equal, or if the difference is within a predetermined tolerance, a proper landing can be made, and the DTG count if forced to equal the zone count. The pattern derived from the distance pulses is continued to be generated, using the new value of the DTG count. Other functions, such as door preopening, may be enabled, since it is now known that the elevator car will land correctly without undershooting and creeping to floor level, or overshooting and releveling.

If the difference between the DTG count and the count representative of the fixed zone exceeds the predetermined tolerance, the DTG count is not corrected, as the car would not land properly, even with the correction, and the jerk which may result may exceed comfortable levels. Door preopening would not be enabled. Other embodiments of the invention utilize the knowledge of the poor landing to take the elevator car out of service in certain instances, and/or to record information for use by service and maintenance personnel.

We claim as our invention:

1. An elevator system, comprising:

a structure having a plurality of floors and a hoistway;

an elevator car mounted for movement in said hoistway to serve the floor;

motive means for moving said elevator car to a target floor;

pulse means responsive to movement of said elevator car for providing distance pulses in response to predetermined standard increments of movement;

means responsive to said distance pulses for providing a count representative of the position of said elevator car in said hoistway;

means responsive to said car position count and to the location of the target floor for providing a distance-to-go (DTG) count representative of the distance between the elevator car and the target floor;

means defining a floor zone adjacent to each floor which has a predetermined dimension;

detector means for detecting the arrival of said elevator car at the target floor zone;

comparator means for comparing the DTG count with the predetermined dimension of the target floor zone in response to said detector means detecting the arrival of said elevator car at the target floor zone;

means responsive to said comparator means for setting the DTG count equal to the predetermined dimension of the floor zone when the DTG count and said predetermined dimension have a predetermined relationship;

and means responsive to the DTG count for providing a speed pattern signal for said motive means, at least when said elevator car is stopping at a target floor.

2. The elevator system of claim 1 wherein the predetermined relationship between the DTG count and the predetermined dimension of the floor zone is a difference value in a predetermined range, with the range being selected such that the change in the speed pattern when the DTG count is corrected from a value in this range will cause the elevator car to stop level with the target floor, without undershooting, overshooting, or exceeding a predetermined jerk.

3. The elevator system of claim 1 wherein the elevator car includes at least one door, and including means responsive to the comparator means for enabling preopening of said door when the DTG count and the predetermined floor zone dimension have the predetermined relationship.

4. The elevator system of claim 3 wherein the predetermined relationship between the DTG count and the predetermined dimension of the floor zone is a difference value in a predetermined range selected such that the change in the speed pattern when the DTG count is corrected from this range will cause the elevator car to stop level with the target floor without undershooting, overshooting, or exceeding a predetermined jerk.

5. The elevator system of claim 1 including memory means, and means for storing the occurrence of a poor landing in said memory means when the DTG count and the predetermined dimension of the floor zone do not have the predetermined relationship.

6. The elevator system of claim 5 including counting means for counting the number of poor landings, and means for taking the elevator car out of service when a predetermined count is reached.

7. The elevator system of claim 6 including means for resetting the counting means after a predetermined period of time.

8. The elevator system of claim 1 including means for taking the elevator car out of service when the comparator means finds the difference between the DTG count and the dimension of the floor zone exceeds a predetermined magnitude.

* * * * *